US005573380A

United States Patent [19]

Martensen et al.

[11] Patent Number: 5,573,380

[45] Date of Patent: Nov. 12, 1996

[54] HYDRAULIC PISTON MACHINE

[75] Inventors: Lars Martensen, Sønderborg; Ove T. Hansen, Nordborg, both of Denmark

[73] Assignee: Danfoss A/S, Nordborg, Denmark

[21] Appl. No.: 425,437

[22] Filed: Apr. 20, 1995

[30] Foreign Application Priority Data

May 13, 1994 [DE] Germany ..... 44 17 011.4

[51] Int. Cl.[6] ..... F04B 1/12; F04B 27/08

[52] U.S. Cl. ..... 417/269; 91/436; 91/499

[58] Field of Search ..... 417/269; 91/499, 91/486

[56] References Cited

U.S. PATENT DOCUMENTS 3,249,061 5/1966 Ricketts ..... 91/486

3,585,901 6/1971 Moon, Jr. ..... 91/499

*Primary Examiner*—Charles Freay

*Attorney, Agent, or Firm*—Lee, Mann, Smith, McWilliams, Sweeney & Ohlson

[57] ABSTRACT

A hydraulic piston machine is disclosed, having a cylinder drum and a control plate, which control plate has at least one high-pressure "kidney" and at least one low-pressure "kidney" and also a contact surface against which the cylinder drum bears in operation, at least the contact surface being provided with a friction-reducing layer. It is desirable for such a machine to have better operational behavior and a longer service life. For that purpose, the contact surface in the region of the low-pressure kidney has a recessed region forming a gap between the cylinder drum and the control plate.

10 Claims, 1 Drawing Sheet

HYDRAULIC PISTON MACHINE

Figure 2:
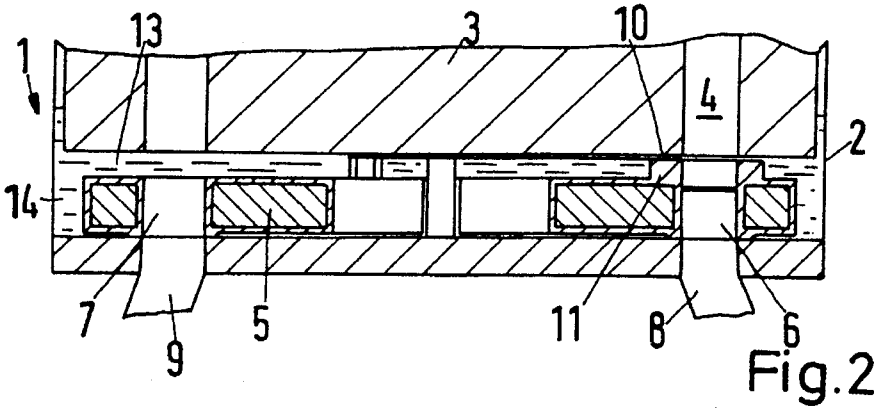

The invention relates to a hydraulic piston machine having a cylinder drum and a control plate, which control plate has at least one high-pressure "kidney" and at least one low-pressure "kidney" and also a contact surface against which the cylinder drum bears in operation, at least the contact surface being provided with a friction-reducing layer.

In a known machine of that kind (JP 2-125 979 A), a plastics layer which is intended to allow low-friction sliding of the cylinder drum on the control plate during operation is arranged between the control plate and the cylinder drum. With this construction, the machine is intended to be operated even when sea water is being used as the hydraulic fluid.

Furthermore, such a machine is disclosed in the post-published German Patent Application P 43 01 133.

In operation, the cylinder drum has to be pressed with a relatively high contact force against the control plate so that the fluid is able to pass from the high- or low-pressure kidney into the cylinders of the cylinder drum and is able to flow back out of the cylinders again into the control plate without escaping laterally between the cylinder drum and the control plate. If the contact force is too low, breaks in the seal occur, leading to leakage. Such leakage impairs the volumetric efficiency of the machine.

Despite the friction-reducing layer, it has been observed that the high contact forces result in heating of the control plate, in particular in the region of the friction-reducing layer. Especially when using plastics material for the friction-reducing layer, this heating can lead to tearing. The layer is torn open and particles of it are carried round by the cylinder drum during operation. These particles then very quickly lead to wear of the other parts of the friction-reducing layer as well. This again causes leaks which further impair the volumetric efficiency in the machine.

The invention is based on the problem of improving the operational behaviour of the machine, and in particular avoiding damage to the control plate.

This problem is solved in a hydraulic piston machine of the kind mentioned in the introduction in that the contact surface in the region of the low-pressure kidney has a recessed region forming a gap between the cylinder drum and the control plate.

It has been shown that heating of the control plate occurs primarily in the region of the low-pressure kidney. This is attributable to the fact that, even with a large contact force, there is a certain amount of leakage in the region of the high-pressure kidney. This leakage can hardly be avoided since at the considerable difference in pressure between the inside of the high-pressure kidney and the inside of a housing surrounding the machine, in which the pressure is substantially ambient or tank pressure, a one hundred percent effective seal is virtually impossible to obtain. The leakage is in that case so small as to be negligible. It has the advantage, however, that the escaping fluid dissipates the heat caused by friction. This heat dissipation is sufficient to avoid excessive heating of the friction-reducing layer and thus its destruction in the region of the high-pressure kidney. In the region of the low-pressure kidney this leakage does not occur, because the pressure within the low-pressure kidney is practically the same as outside it, that is, ambient or tank pressure. The frictional heat generated in the region of the low-pressure kidney cannot therefore be dissipated by escaping fluid. By constructing the control plate with a recess in the region of the low-pressure kidney, the cylinder drum is prevented from rubbing on the control plate in this region. Generation of frictional heat in this region is therefore prevented from the outset. It is also impossible for over-heating of the control plate or of the friction-reducing layer in this region to occur. The gap that is created is not critical, because, as stated, the pressure within the low-pressure kidney is practically the same as outside it. Of course, as there is a gap it is inevitable that small quantities of fluid will escape through the gap. These quantities, however, have virtually no influence on the volumetric efficiency of the machine, because they do not adversely affect the filling level in the cylinder drum. In the case of a pump, it will in most cases be irrelevant whether the fluid is sucked out of the suction port or out of the housing. The relatively simple measure of interrupting the contact surface in the region of the low-pressure kidney and providing a space between the cylinder drum and the control plate improves the life of the machine and its efficiency quite dramatically.

The recessed region preferably extends at most to respective radial lines extending from the midpoint of the control plate through the midpoint of a respective circle described in each end of the low-pressure kidney. The end of the kidney need not be circular. The described circle is the largest circle that just fits into the end. The recessed region does not therefore surround the low-pressure kidney completely. In the end regions of the low-pressure kidney the contact surface is still present. The commutation of the machine with respect to other machines without a recess in the contact surface can therefore remain unchanged. The regions in which frictional heat occurs here, without being carried away by fluid, are small and lie sufficiently far out for the heat to be dissipated quickly enough without cooling by fluid.

It is also preferred for the recessed region to be divided into several subregions between which there is at least one residual area of contact surface. The residual area of contact surface then allows the cylinder drum to be supported also in the region of the low-pressure kidney, so that the cylinder drum and the control plate can be balanced well. The danger of the two parts tilting relative to one another is thus kept to an insignificant level. The residual areas of contact surface can in that case be selected to be so small that, firstly, no appreciable frictional heat occurs and, secondly, any frictional heat that does occur can be dissipated sufficiently quickly to the outside.

The residual areas of contact surface are arranged, viewed in the radial direction, preferably only on one side of the low-pressure kidney. This is sufficient to support the cylinder drum. On the other hand, the friction area is further reduced.

It is especially preferred for the residual area of contact surface to be arranged in the middle of the low-pressure kidney. The cylinder drum is therefore largely symmetrically supported.

The recessed region is advantageously provided only in the material forming the friction-reducing layer. The gap formed by the recessed region between cylinder drum and control plate can be relatively small. Basically speaking, it need only be large enough for contact between the control plate and the cylinder drum during operation to be substantially excluded. Its thickness is therefore only a few tenths or even hundredths of a millimeter. When the gap is so small, however, it is sufficient for the material of the friction-reducing layer to be removed at least partially in this region. The material of the friction-reducing layer can in many cases be more easily worked or shaped than the material of the control plate itself.

In particular, the recessed region can be formed by removing material. The material can here be milled out or scraped off. Other machining options are also possible.

In another preferred construction, provision is made for the friction-reducing layer to be moulded onto the control plate, and in particular for it to be injection-moulded onto the control plate, the recessed region being formed by a suitable negative shape of the mould. When the friction-reducing layer is in the form of an injection-moulded part which is moulded in situ onto the control plate, the negative form can, of course, also be formed so that the recessed region is created directly as injection-moulding is taking place.

In a further construction, provision is made for the friction-reducing layer to be provided only outside the recessed region. In that case, the friction-reducing layer can be dispensed with entirely in the recessed region, which represents a saving in the material of the friction-reducing layer. The control plate can therefore be more cheaply constructed.

The machine advantageously has a housing, which is filled approximately to the level of the recessed region with hydraulic fluid. Because of the leakage in the region of the high-pressure kidney, sooner or later the housing fills up in any case with hydraulic fluid. For that purpose, it is normally necessary to provide a separate drain point. By constructing the machine with a gap between the control plate and the cylinder drum in the region of the low-pressure kidney, this drain connection from the housing can be made smaller or can even be omitted completely. When the machine is operated as a pump, the hydraulic fluid in the housing is in fact forced into the cylinder during the suction stroke and when the machine is operated as a motor the hydraulic fluid is forced into the tank during the exhaust stroke.

The machine is preferably operable with water as the hydraulic fluid. This is easily possible because of the friction-reducing layer between the control plate and the cylinder drum. Water is very much less harmful to the environment than the hydraulic oils used previously in the majority of cases.

In a preferred construction, provision is made for the control plate to be removed entirely or partially in the recessed region. When the control plate is entirely removed in the recessed region, a slice of cake, as it were, is cut out. In that case the gap is then no longer formed between the cylinder drum and the control plate, but between the cylinder drum and the housing wall. The hydraulic fluid enters the housing in greater quantities, but, as shown above, this is not critical. When the machine is operated as a pump, it is immaterial, for example, whether the fluid is sucked in directly from the suction connection or whether it first enters the housing and is sucked away from there. When the machine is operated as a motor, it is sufficient for the fluid to flow out of the housing to the tank.

Figure 1:
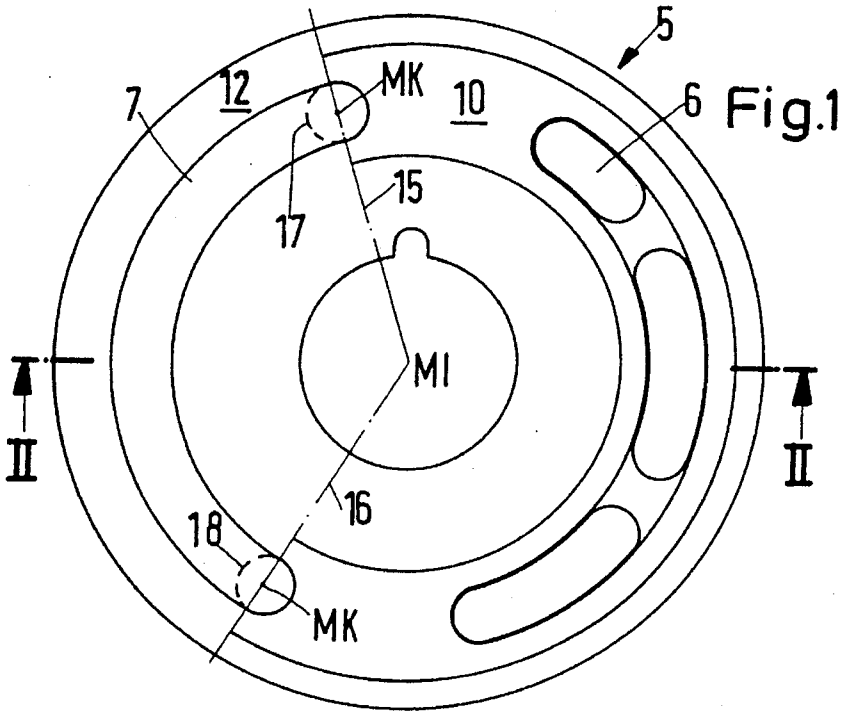
Figure 4:
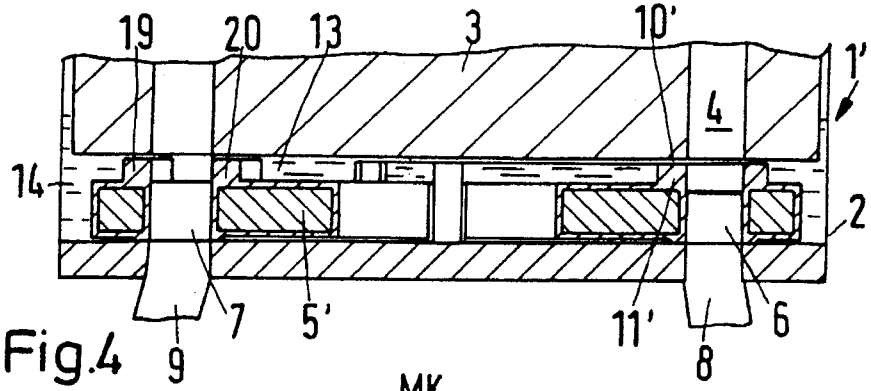
Figure 3:
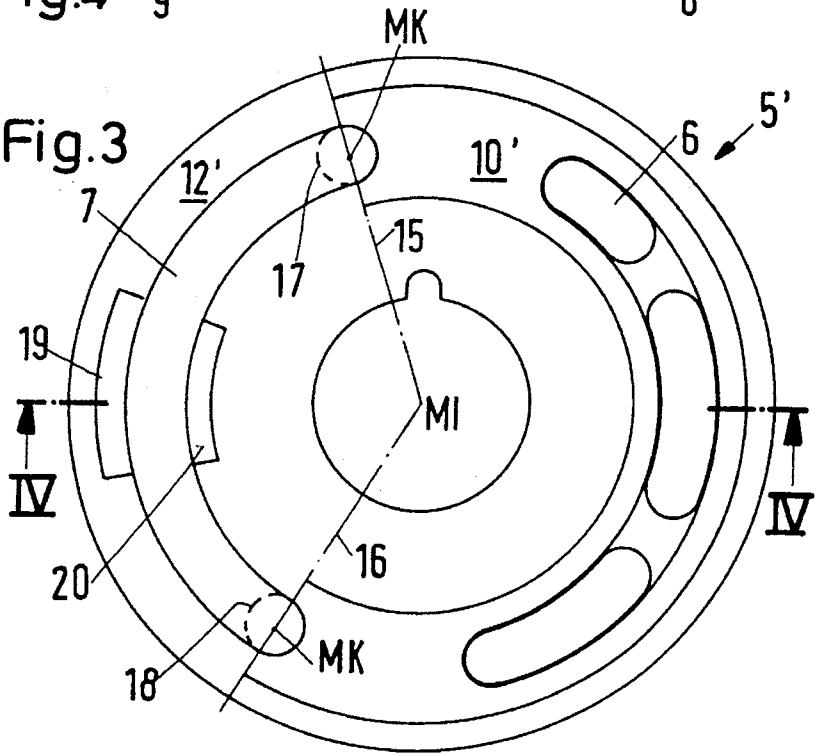

The invention is described hereinafter with reference to preferred embodiments in conjunction with the drawings, in which FIG. 1 is a plan view of a first embodiment of a control plate, FIG. 2 is a section II—II according to FIG. 1, including additionally a housing, FIG. 3 is a second embodiment corresponding to FIG. 1, and FIG. 4 is a section IV—IV according to FIG. 3.

A hydraulic piston machine 1, which in this particular case is in the form of an axial piston machine, comprises in a housing 2 a cylinder drum 3, in which several cylinders 4 are arranged. The cylinder drum 3 is arranged to be rotatable with respect to a control plate 5. As it rotates, the cylinders 4 coincide alternately with a high-pressure kidney 6 and a low-pressure kidney 7, which are connected to a high-pressure connection 8 and a low-pressure or tank connection 9 respectively.

The mode of operation of such a machine is known per se. On rotation of the cylinder drum 3, the pistons, not shown specifically, move to and fro in the cylinders 4. The pistons are supported here on a slanting plate, likewise not shown. Such a machine can be used either as a pump or as a motor. When operated as a motor, hydraulic fluid is supplied to the cylinders by way of the high-pressure connection 8 and the high-pressure kidney 6. When operated as a pump, the hydraulic fluid is sucked through the low-pressure kidney 7 and the tank connection 9 and delivered through the high-pressure kidney and the high-pressure connection 8.

To achieve a particular degree of sealing at the transition from the kidneys 6, 7 to the cylinders 4 despite the fact that the cylinder drum 3 and the control plate 5 move relative to one another, the cylinder drum 3 is pressed with considerable force against the control plate 5. The cylinder drum 3 here bears against a contact surface 10 of the control plate 5. When using oil as the hydraulic fluid, the hydraulic fluid is used to lubricate this contact surface in order to keep friction and thus wear and tear low. If, on the other hand, water is used as the hydraulic fluid, this lubricating function of the hydraulic fluid can no longer be exploited. In that case, a friction-reducing layer of a plastics material is used, in particular a plastics material from the group of high-performance thermoplastic plastics materials, preferably on the basis of polyaryletherketones, for example, polyetheretherketones, polyamides, polyacetals, polyarylethers, polyethyleneterephthalates, polyphenylenesulphides, polysulphones, polyethersulphones, polyetherimides, polyamideimide, polyacrylates, phenolic resins or similar substances. Glass, graphite, polytetrafluoroethylene or carbon, in particular in fibre form, can be used as fillers.

In order to achieve an intimate bond of the friction-reducing layer 11 with the control plate 5, the friction-reducing layer can be injection-moulded onto the control plate 5. The friction-reducing layer can even be constructed so that it encloses the control plate 5. In the region of the contact surface 10, the friction-reducing layer 11 has a somewhat greater thickness, shown greatly exaggerated in FIG. 2 for reasons of clarity.

Although the friction-reducing layer 11 enables the cylinder drum 3 to slide with little friction on the control plate 5, it is nevertheless inevitable that a certain frictional heat will occur. In the region of the high-pressure kidney 6, this frictional heat is not so critical. The connection between the high-pressure kidney 6 and the cylinders 4 cannot in practice be sealed with ordinary effort; small leaks will always occur. In this particular case, this is desirable, because the hydraulic fluid that escapes between the control plate 5 and the cylinder drum 3 in the region of the high-pressure kidney 6 is used to dissipate the frictional heat. Overheating of the plastics material of the friction-reducing layer 11 does not occur here.

It is a different matter in the region around the low-pressure kidney 7. Here, the pressure in the cylinder 4 and in the low-pressure kidney 7 is virtually the same as ambient pressure. The hydraulic fluid here normally has no impulsion to escape and thus dissipate heat. Sooner or later this leads to heating of the control plate 5 and the friction-reducing layer 11, which can result in the friction-reducing layer 11 tearing.

To eliminate this phenomenon, in the embodiment illustrated the contact surface 10 in the region of the low-pressure kidney 7 is provided with a recess 12, which forms a gap 13 between the cylinder drum 3 and the control plate 5. This gap 13 is also illustrated to be exaggeratedly deep. In reality it will be only a few hundredths of a millimeter thick. The only function of the gap is to avoid contact between the cylinder drum 3 and the control plate 5 in the region of the low-pressure kidney, so that no frictional heat occurs there. Moreover, the gap 13 naturally has the advantage that the end face of the cylinder drum 3, which normally bears on the contact surface 10, has the opportunity to cool down, so that overall the thermal balance can be improved even in the region of the high-pressure kidney 6.

Although there is no seal-forming connection between the cylinders 4 and the low-pressure kidney 7 here, this is not critical, because here the pressures in the low-pressure kidney 7 and inside the housing 2 are virtually the same. Hydraulic fluid is able to escape. The amount of escaping hydraulic fluid is negligibly small, however. Since moreover it escapes only at one point of the circulation of the hydraulic fluid, where there is no more work to be done, the amount of fluid escaping here is virtually irrelevant to the balance sheet for volumetric efficiency. In the case of a pump, it is more often than not immaterial, for example, whether the fluid is sucked from the suction connection or from the housing.

This gap 13 can even advantageously be used for other purposes. As mentioned above, in the region of the high-pressure kidney 6 a certain small amount of hydraulic fluid 14 always escapes into the housing 2. To drain off this fluid, a separate drain connection is normally needed, which returns the hydraulic fluid to the tank. If, however, the machine is designed so that the housing 2 is always filled with hydraulic fluid 14 at least to the level of the gap 13, the hydraulic fluid 14 in question can be sucked away through the low-pressure kidney 7 (in motor operation) and through the cylinder 4 (in pump operation). The low-pressure kidney 7 and the cylinders 4 then act in the manner of a water jet pump.

The recess 12 does not surround the low-pressure kidney 7 completely. On the contrary, it extends between two radial lines 15, 16 which extend from the midpoint MI of the control plate 5 through the midpoints MK of circles 17, 18 which are described in the ends of the low-pressure kidney 7. The contact surface 10 thus maintains a certain coverage which reliably allows commutation of the individual cylinders.

The embodiment shown in FIGS. 1 and 2 illustrates that the recess 12 takes up the entire area between the two radial lines 15, 16.

FIGS. 3 and 4 show a second embodiment of a machine 1' in which identical parts are provided with the same reference numbers and corresponding parts are provided with dashed reference numbers.

Unlike the embodiment shown in FIGS. 1 and 2, the recess 12' does not extend for the entire region between the two radial lines 15, 16, but is interrupted by residual areas of contact surface 19, 20. The contact surface residual areas are here illustrated on each side of the low-pressure kidney 7. Basically speaking, however, it is sufficient for them to be present only on one side, that is, radially inside or radially outside. They are preferably arranged approximately in the middle of the low-pressure kidney 7. They serve to support the cylinder drum 3 with respect to the control plate 5' so that the arrangement can be better balanced.

The residual areas 19, 20 of contact surface are so small that the frictional heat generated there is virtually negligible. Apart from that, it can be dissipated relatively quickly to the outside because of the small area occupied, so that no appreciable overheating can occur.

The recess 12, 12' can be produced in different ways. It can, for example, be milled out. It can also be formed directly during moulding of the friction-reducing layer 11, 11'. Finally, a friction-reducing layer can be omitted altogether in the region of the recess 12, 12'. This simplifies machining. Otherwise it is always an advantage to provide the recess 12, 12' only in the friction-reducing layer, and not in the core material of the control plate 5, 5'.

Water is preferably used as hydraulic fluid 14.

We claim:

1. A hydraulic piston machine having a cylinder drum and a control plate, which control plate has at least one high-pressure kidney and at least one low-pressure kidney and also a contact surface against which the cylinder drum bears in operation, at least the contact surface being provided with a friction-reducing layer, and in which the contact surface in the region of the low-pressure kidney has a recessed region forming a gap between the cylinder drum and the control plate.

2. A machine according to claim 1, in which the recessed region extends to respective radial lines extending from a midpoint of the control plate through a midpoint of a respective circle described in each end of the low-pressure kidney.

3. A machine according to claim 1 in which the recessed region is divided into several subregions between which there is at least one residual area of contact surface.

4. A machine according to claim 3, in which the residual areas of contact surface are arranged on at least one side of the low-pressure kidney.

5. A machine according to claim 3 in which the residual area of contact surface is arranged adjacent a middle area of the low-pressure kidney.

6. A machine according to claim 1 in which the recessed region is provided only in material forming the friction-reducing layer.

7. A machine according to claim 1 in which the friction-reducing layer is injection-moulded onto the control plate, the recessed region being formed by a suitable negative shape of a mould used for injection-moulding.

8. A machine according to claim 1 in which the friction-reducing layer is located outside the recessed region.

9. A machine according to claim 1 including a housing which is filled approximately to the level of the recessed region with hydraulic fluid.

10. A machine according to claim 1 in which water is the hydraulic fluid.

* * * * *